US005944036A

United States Patent [19]

Allen

[11] Patent Number: 5,944,036

[45] Date of Patent: Aug. 31, 1999

[54] HIGH PRESSURE SLUDGE REMOVER

[76] Inventor: Henry W. Allen, 12014 Lake Lery Ave., Baton Rouge, La. 70816

[21] Appl. No.: 09/013,459

[22] Filed: Jan. 26, 1998

Related U.S. Application Data

[60] Provisional application No. 60/036,459, Jan. 27, 1997.

[51] Int. Cl.[6] ..... B08B 3/02

[52] U.S. Cl. ..... 134/167 R; 134/168 R; 134/181

[58] Field of Search ..... 134/181, 167 R, 134/172, 201, 168 R, 182, 183, 175

[56] References Cited

U.S. PATENT DOCUMENTS

| | | | |
|---|---|---|---|
| 4,191,590 | 3/1980 | Sundheim | 134/181 |
| 4,827,563 | 5/1989 | Gordon | 134/181 |
| 5,078,799 | 1/1992 | Matter et al. | 134/167 R |
| 5,138,741 | 8/1992 | Allen | 15/340.1 |
| 5,269,041 | 12/1993 | Allen | 15/340.1 |
| 5,293,887 | 3/1994 | Thibodeaux | 134/167 R |
| 5,301,702 | 4/1994 | McKinney | 134/167 R |
| 5,312,044 | 5/1994 | Eaton | 134/181 |
| 5,335,395 | 8/1994 | Allen | 15/340.1 |
| 5,640,982 | 6/1997 | Landry et al. | 134/167 R |
| 7,740,821 | 4/1998 | Arnold | 134/181 |

*Primary Examiner*—Frankie L. Stinson
*Attorney, Agent, or Firm*—David L. Ray

[57] ABSTRACT

A high pressure liquid sludge cutter for pulverizing sludge in a sludge storage area to enable the sludge to be removed by pumps on a remote controlled sludge removal apparatus. The invention includes a plurality of nozzles located on a rotating and oscillating header. The nozzles are aligned to spray high pressure water onto the sludge, and the rotation and oscillation of the header enables rapid and thorough removal of the sludge located at the bottom of a sludge storage area.

20 Claims, 4 Drawing Sheets

HIGH PRESSURE SLUDGE REMOVER

CROSS-REFERENCE TO RELATED APPLICATIONS

This application claims the benefit of the filing date and priority of co-pending provisional application Ser. No. 60/036,459 filed Jan. 27, 1997.

BACKGROUND OF THE INVENTION

1. Field of the Invention

The invention relates to remote controlled sludge removal apparatus. More particularly, the invention relates to devices for breaking sludge loose from sludge deposits to enable the sludge to be pumped from the sludge storage area by a remote controlled sludge removal apparatus.

2. Description of the Related Art

My U.S. Pat. Nos. 5,335,395; 5,269,041; and 5,138,741 disclose sludge removal apparatus having tracks thereon for propelling the sludge removal apparatus over the area from which sludge is being removed. In my above mentioned U.S. Patents, sludge located at the bottom of a sludge storage area was dug up by an auger.

It is an object of the present invention to provide an improved apparatus for removing sludge from the bottom of a sludge storage area.

SUMMARY OF THE INVENTION

In accordance with the present invention there is provided a high pressure liquid sludge cutter for removing sludge from the surface of a sludge storage area to enable the sludge to be removed by pumps on a remote controlled sludge removal apparatus. The invention includes a plurality of nozzles located on a rotating and oscillating header. The nozzles are aligned to contact the sludge. The rotation and oscillation of the header enables rapid and thorough removal of the sludge in a sludge storage area.

DESCRIPTION OF THE PREFERRED EMBODIMENTS

The remote control sludge removal apparatus for which the high pressure sludge remover of the invention is particularly useful is disclosed in my U.S. Pat. Nos. 5,335,395; 5,269,041; and 5,138,741, which are hereby incorporated by reference.

Figure 1:
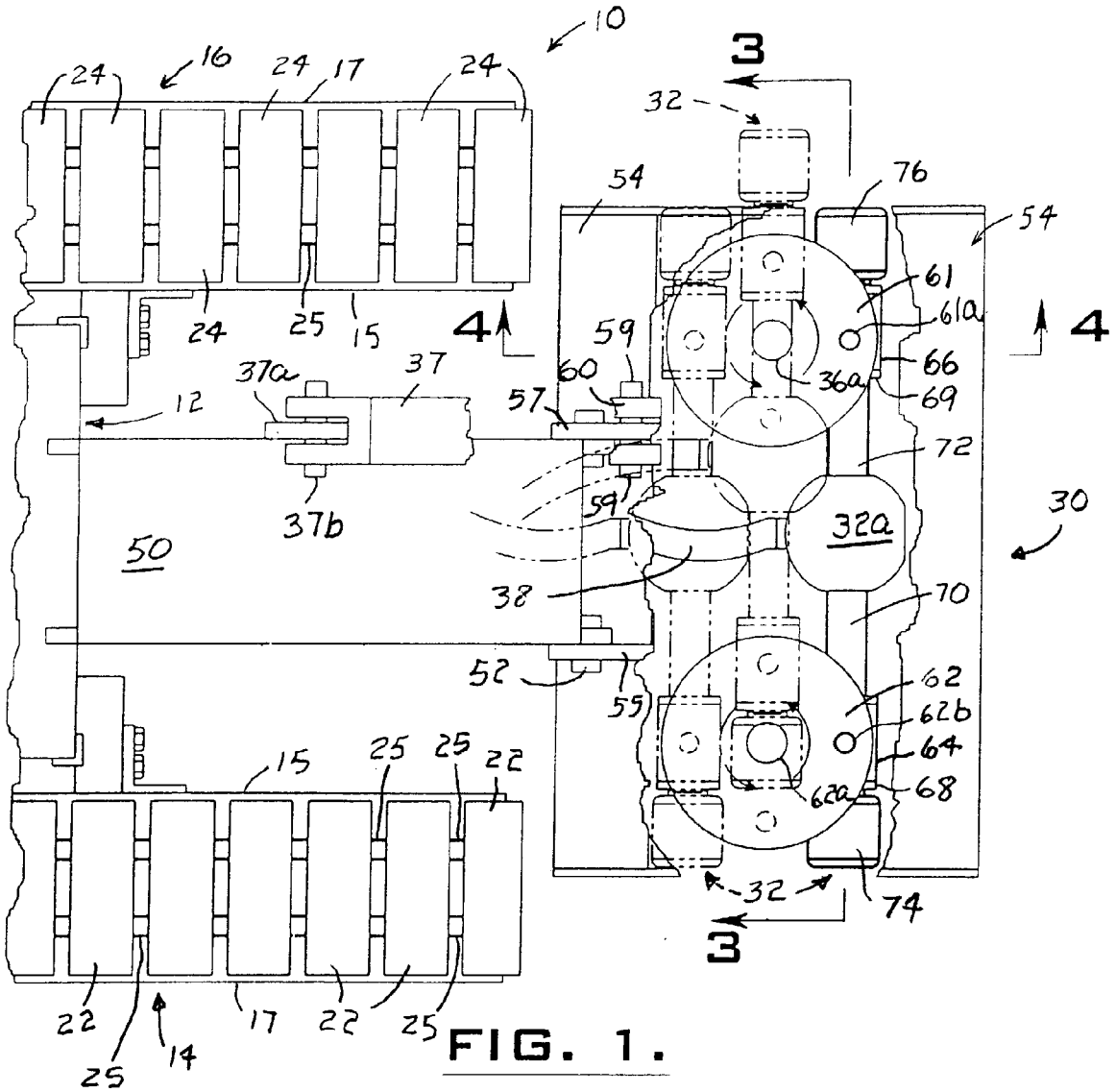
FIG. 1 is a partly cut-away top schematic view of a portion of a sludge removal apparatus having the invention connected thereto with alternate positions of the invention being shown in phantom lines.
Figure 2:
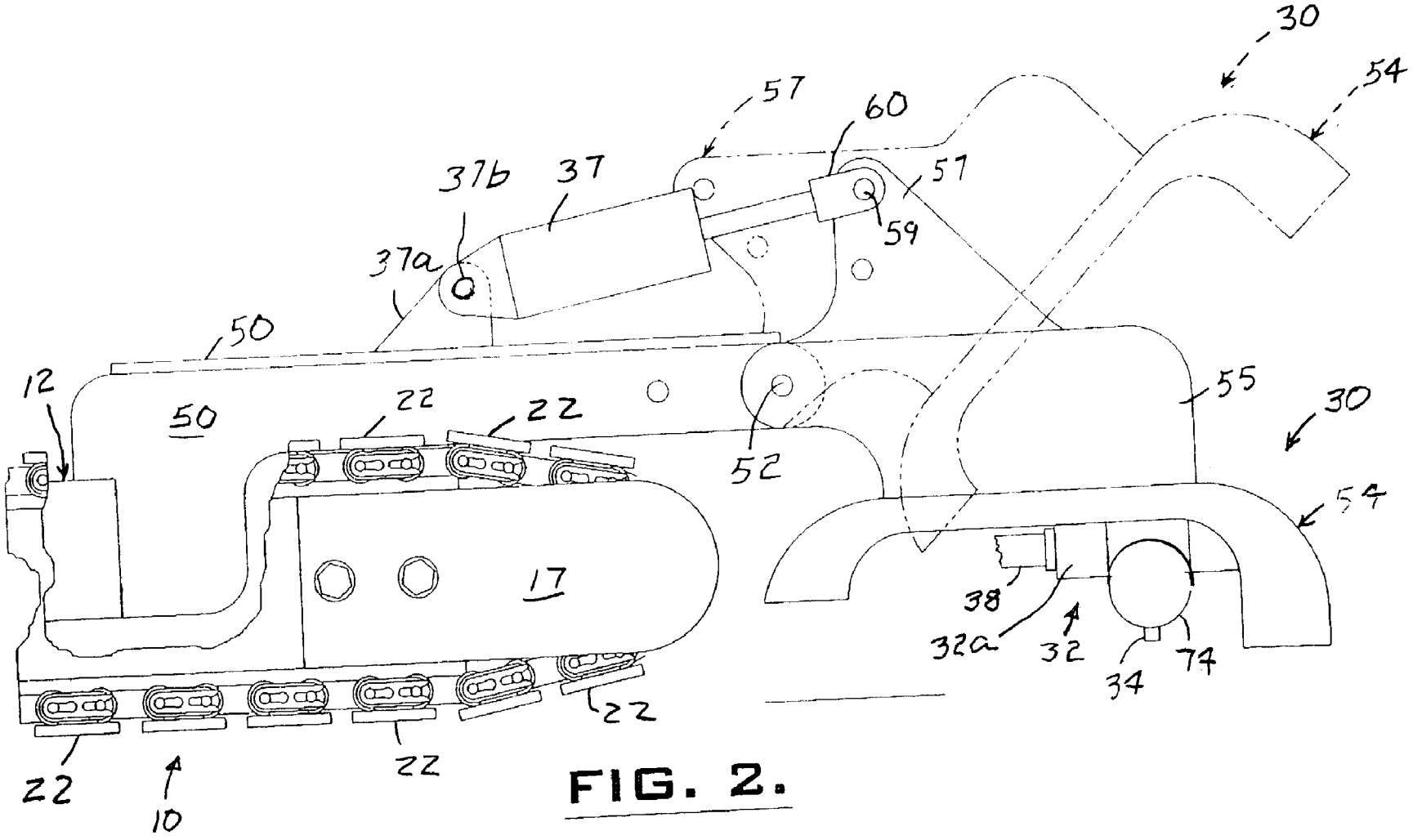
FIG. 2 is a side elevational view partly cut-away of a sludge removal apparatus having the invention connected thereto with the invention shown in the raised position in phantom lines.

Referring now to the drawings, and in particularly to FIGS. 1 and 2, the sludge removal apparatus of U.S. Pat. Nos. 5,335,395; 5,269,041; and 5,138,741 can be seen to be generally indicated by the numeral 10. By sludge is meant the viscous residue of hydrocarbons such as crude oil, sewerage digester settlement, sludge contained in sludge pits, radioactive nuclear waste deposited on the bottom of a radioactive nuclear waste storage areas, or any other type of sludge which is desired to be removed from a sludge containment area.

The sludge removal apparatus 10 shown in FIGS. 1 and 2 and disclosed U.S. Pat. Nos. 5,335,395; 5,269,041; and 5,138,741 includes a platform generally indicated by the numeral 12 which is connected to two track assemblies generally indicated by the numerals 14 and 16 having inside track assembly walls 15 and outside track assembly walls 17, respectively. Mounted on platform 12 is a pump (not shown) having a discharge (not shown) and a bottom intake (not shown) connected thereto.

Connected to each of the track assemblies 14 and 16 are tracks 22 and 24 respectively. Tracks 22 and 24 are driven at the rear ends (not shown) by motors (not shown) respectively. Tracks 22 and 24 are connected by chain links 25.

Figure 4:
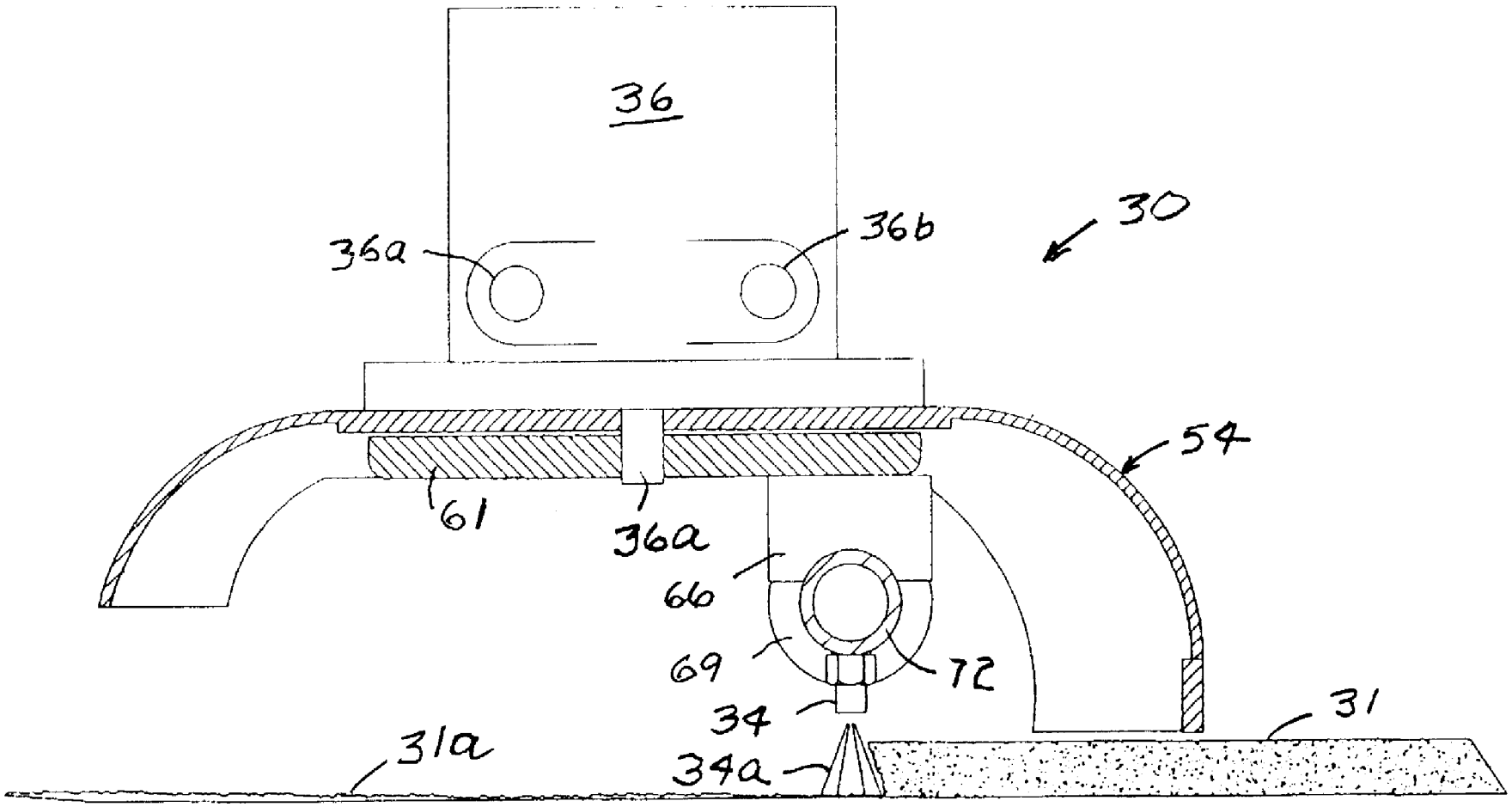
FIG. 4 is a cross sectional view taken along lines 4—4 of FIG. 1.

The high pressure sludge remover of the invention is generally indicated by the numeral 30 and replaces the two auger assemblies that were located at the front of each track assembly 14 and 16 of the sludge removal apparatus 10 which is disclosed U.S. Pat. Nos. 5,335,395; 5,269,041; and 5,138,741 to cut and comminute sludge 31 as shown in FIG. 4 by jets of high pressure water 34*a*. Jets 34*a* force comminuted or pulverized sludge 31*a* to the area between the track assemblies 14 and 16 and beneath platform 12 for intake and removal by a pump (not shown) on platform 12 of sludge removal device 10.

Sludge remover 30 includes a rotating/oscillating header generally indicated by the numeral 32 having nozzles 34 thereon. Header 32 is rotated and oscillated by hydraulic motor 36, and positioning of the tool upward and downward is controlled by hydraulic cylinder 37. Hydraulic motor has an inlet port 36*a* and an outlet port 36*b* for inlet and outlet of pressurized hydraulic fluid to drive the motor 36.

Sludge remover 30 can be moved upward and downward as shown in FIG. 2 in phantom lines at various degrees up to about 67° above the horizontal to dislodge various types of sludge 31 or other materials to be dislodged Water is supplied to header 32 through inlet hose 38 for at pressures ranging form 10,000–30,000 pounds per square inch (psi) at 8–15 gallons per minute (gpm). Header 32 is capable of dislodging sludge and breaking concrete into slurries.

Additional water is added as needed to control solid concentrations in the sludge containing slurry created by the sludge and water exiting from nozzles 34-34. Preferably, the discharge tips of the spray nozzles 34 installed in the spray header 32 should be a minimum of one inch above the horizontal when the sludge remover 30 is in the horizontal position shown in solid lines in FIG. 2.

As can be seen in FIGS. 1 and 2, high pressure sludge remover 30 is connected to platform 12 by support assembly 50 which is rigidly connected to platform 12. High pressure sludge remover 30 is pivotally connected to support assembly 50 at pins 52 and 53 and rotates upwardly and downwardly on pins 52 and 53 as shown in FIG. 2. Hydraulic piston 37 is connected to piston support 37*a* by pin 37*b*, and piston support 37*a* is rigidly connected to the support assembly generally indicated by the numeral 50.

Figure 3:
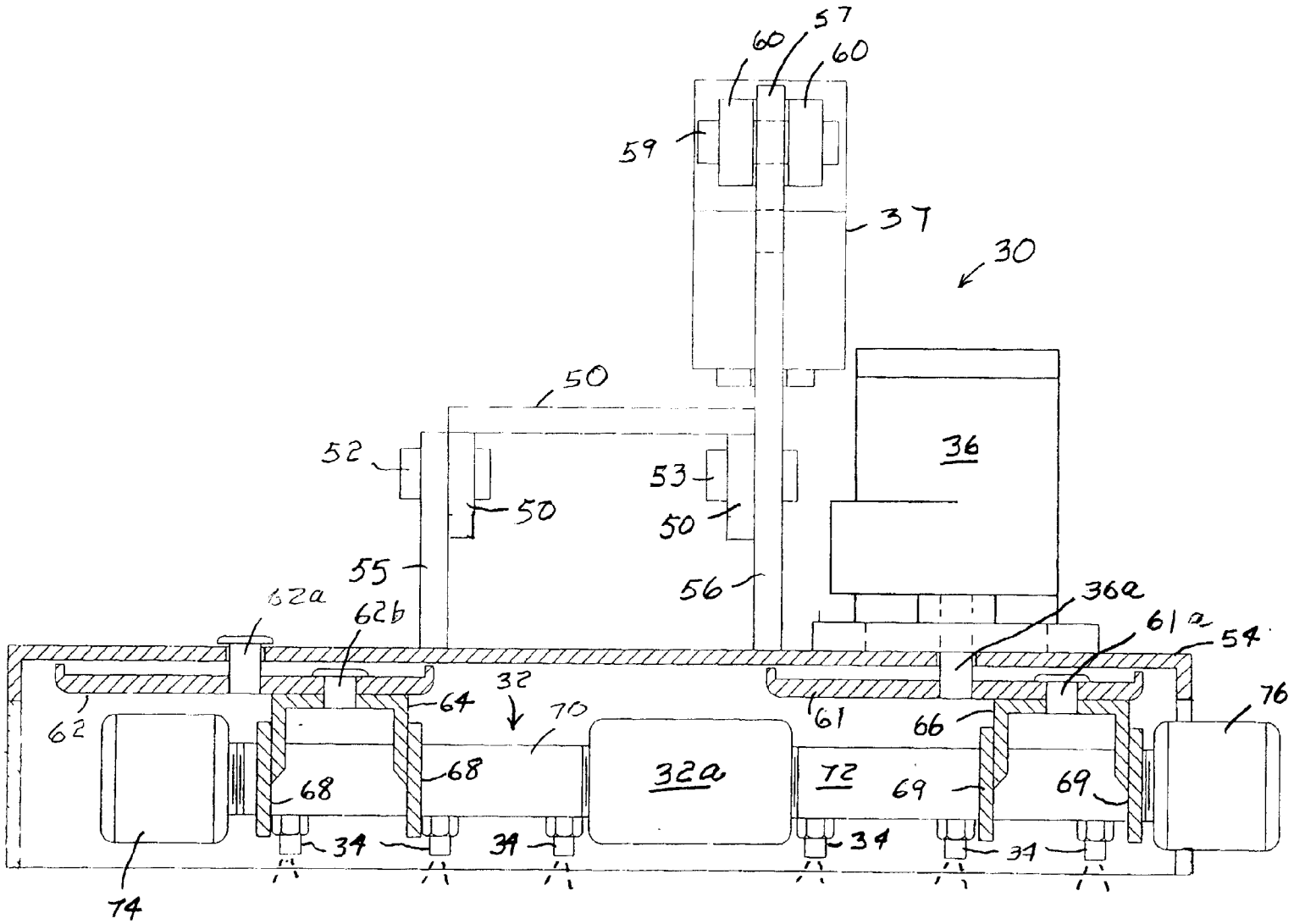
FIG. 3 is a cross sectional view taken along lines 3—3 of FIG. 1.

Sludge remover 30 has a cover generally indicated by the numeral 54. As shown in FIGS. 2 and 3, cover 54 has two brackets 55 and 56 rigidly connected thereto. Bracket 55 is rotatably connected to support assembly 50 by pin 52, and bracket 56 is rotatably connected to support assembly 50 by pin 53.

Bracket 56 has an upwardly extended portion 57 which is rotatably connected to pin 59. Pin 59 also rotatably connects the outwardly extending piston 60 from hydraulic cylinder 37 to upwardly extended portion 57.

As can be seen in FIG. 3, motor 36 is connected to the top of cover 54. Motor 36 has a drive shaft 36*a* which extends downwardly through cover 54 to circular disk 61. Motor 36 turns circular disk 61 in a circular direction indicated by the arrows on circular disk 61 shown in FIG. 1. A second circular disk 62 is rotatably pinned to cover 54 by pin 62*a*.

Header 32 is rotatably connected to circular disks 61 and 62 by pins 61*a* and 62*b*, respectively. Pins 62*b* and 61*a* are rigidly connected to brackets U-shaped brackets 64 and 66, respectively. U-shaped brackets 64 and 66 are rigidly connected to brackets 68-68 and brackets 69-69, respectively. Brackets 68-68 and brackets 69-69 are rigidly connected to pipes 70 and 72 of header 32.

Two caps 74 and 76 are threaded on each outer end of pipes 70 and 72 respectively to seal the outer ends pipes 70 and 72 and prevent water from leaking therefrom. A central manifold 32*a* located in the center of header 32 threadably receives pipe 70 and 72.

Header 32 has an inlet hose 38 for supplying water thereto. Nozzles 34-34 are attached to pipes 70 and 72. Water flowing through inlet hose 38 enters manifold 32*a*, travels outwardly through pipes 70 and 72, and outwardly through jets 34-34 onto sludge 31.

As can be seen in FIG. 1, hydraulic motor rotates disk 61 in the direction indicated by the arrows on disk 61. If desired, hydraulic motor 36 could be modified to rotate disk 61 in the opposite direction. As disk 61 rotates in the direction indicated by the arrows in FIG. 1, header 32 is caused to rotate and oscillate as header 32 forces disk 62 to turn in the direction indicated by the arrows on disk 62. The various positions that manifold 32 will assume are shown in solid lines and in phantom lines in FIG. 1.

Although the preferred embodiments of the invention have been described in detail above, it should be understood that the invention is in no sense limited thereby, and its scope is to be determined by that of the following claims:

What is claimed is:

1. A high pressure liquid sludge remover for pulverizing sludge in a sludge storage area to enable the sludge to be removed by pumps on a remote controlled sludge removal apparatus, said sludge remover comprising:

a. a rigid cover, said cover having a top side and a bottom side, b. two rotatable discs aligned in a plane, said discs being rotatably connected to the bottom side of said cover;

c. a motor connected to one of said two discs for rotating said disc, c. a rigid, elongated header rotatably connected to each of said discs, d. a liquid supply connected to said header for providing liquid under pressure to said header, e. a plurality of nozzles connected to said elongated header, said nozzles being aligned to direct liquids onto said sludge as said header and said nozzles rotate and oscillate, and f. a support assembly connected to said cover for connecting said cover to said remote controlled sludge removal apparatus, said support assembly having a cylinder connected to said cover for moving said cover upward and downward.

2. The sludge remover of claim 1 wherein said header is rotatably connected to said two discs by pins.

3. The sludge remover of claim 2 wherein said header has a central manifold having two pipes extending in opposite directions therefrom.

4. The sludge remover of claim 3 wherein one of said pipes is connected to one of said two disc means by one of said pins and the other of said two pipes is rotatably connected to the other of said two discs by another of said pins.

5. The sludge remover of claim 4 wherein said liquid supply is connected to said central manifold.

6. The sludge remover of claim 5 wherein said nozzles are connected to each of said two pipes.

7. The sludge remover of claim 1 wherein said cover has two brackets connected to the top side thereof.

8. The sludge remover of claim 7 wherein said cover is connected to said support assembly by said brackets.

9. The sludge remover of claim 8 wherein said brackets are connected to said support assembly by pins.

10. A high pressure liquid sludge remover for pulverizing sludge in a sludge storage area to enable the sludge to be removed by pumps on a remote controlled sludge removal apparatus, said sludge remover comprising:

a. a rigid cover means, said cover means having a top side and a bottom side, b. two rotatable disc means aligned in a plane, said disc means being rotatably connected to the bottom side of said cover means;

c. a motor connected to one of said two disc means for rotating said disc, c. a rigid, elongated header means rotatably connected to each of said disc means for spraying liquids onto said sludge, d. a liquid supply means connected to said header means for providing liquid under pressure to said header means, e. a plurality of nozzle means connected to said header means, said nozzle means being aligned to direct liquids onto said sludge as said header means and said nozzle means rotate and oscillate, and f. a support assembly means connected to said cover for connecting said cover to said remote controlled sludge removal apparatus, said support assembly having a cylinder connected to said cover for moving said cover upward and downward.

11. The sludge remover of claim 10 wherein said header means is rotatably connected to said two disc means by pin means.

12. The sludge remover of claim 11 wherein said header means has a central manifold means having two pipe means extending in opposite directions therefrom.

13. The sludge remover of claim 12 wherein one of said pipe means is connected to one of said two disc means by said pin means and the other of said two pipe means is connected to the other of said two disc means by said pin means.

14. The sludge remover of claim 13 wherein said liquid supply means is connected to said central manifold means.

15. The sludge remover of claim 14 wherein said nozzle means are connected to each of said two pipe means.

16. The sludge remover of claim 15 wherein said cover means has two bracket means connected to said top side thereof.

17. The sludge remover of claim 16 wherein said cover means is connected to said support assembly means by said bracket means.

18. The sludge remover of claim 17 wherein said bracket means are connected to said support assembly means by pins.

19. The sludge remover of claim 10 wherein said cover means has two bracket means connected to said top side thereof.

20. The sludge remover of claim 19 wherein said cover means is connected to said support assembly means by said bracket means.

* * * * *